US006782866B2

(12) United States Patent
Duncan

(10) Patent No.: US 6,782,866 B2
(45) Date of Patent: Aug. 31, 2004

(54) ROTARY MACHINE AND THERMAL CYCLE

(75) Inventor: Ronnie J. Duncan, Entiat, WA (US)

(73) Assignee: Saddlerock Technologies LLC, Washington ( * ) Notice: Subject to any disclaimer, the term of this patent is extended or adjusted under 35 U.S.C. 154(b) by 0 days.

(21) Appl. No.: 10/261,174

(22) Filed: Sep. 30, 2002

(65) Prior Publication Data

US 2003/0116119 A1 Jun. 26, 2003

Related U.S. Application Data

(62) Division of application No. 09/850,937, filed on May 7, 2001, now Pat. No. 6,484,687.

(51) Int. Cl.[7] ..... F02B 53/00

(52) U.S. Cl. ..... 123/241; 123/200; 123/246; 123/249; 418/227; 418/166; 418/165; 418/191

(58) Field of Search ..... 123/241, 249, 123/246, 200, 206, 231, 229; 60/39.6, 39.63; 418/227, 191, 165, 166, 168, 196

(56) References Cited

U.S. PATENT DOCUMENTS

| | | | | | |
|---|---|---|---|---|---|
| 6,962 | A | | 12/1849 | Thompson | |
| 230,862 | A | | 8/1880 | Cook | 418/191 |
| 726,896 | A | | 5/1903 | Franzen | 418/167 |
| 805,552 | A | | 11/1905 | Hofe | 418/191 |
| 1,061,107 | A | | 5/1913 | Nordmark | |
| 1,235,786 | A | | 8/1917 | Fleming | |
| 1,721,855 | A | | 7/1929 | Burrow | |
| 1,846,298 | A | | 2/1932 | Alcnauer | |
| 2,018,391 | A | | 10/1935 | Whitfield | 418/168 |
| 2,870,752 | A | | 1/1959 | Breelle | 123/246 |
| 2,920,610 | A | | 1/1960 | Breelle | 123/246 |
| 2,939,438 | A | | 6/1960 | Bush | |
| 3,040,530 | A | | 6/1962 | Yalnizian | |
| 3,137,280 | A | | 6/1964 | Jacobson et al. | |
| 3,479,923 | A | | 11/1969 | Tripp | |
| 3,621,820 | A | | 11/1971 | Newsom | 123/246 |
| 3,789,809 | A | | 2/1974 | Schubert | 123/241 |
| 3,810,721 | A | | 5/1974 | Eyer | 418/165 |
| 3,850,150 | A | * | 11/1974 | Plevyak | 123/246 |
| 3,973,527 | A | | 8/1976 | Nilsson et al. | 123/241 |
| 4,457,680 | A | | 7/1984 | Paget | 418/191 |
| 4,490,101 | A | | 12/1984 | Wankel | 418/191 |
| 4,553,513 | A | | 11/1985 | Miles et al. | 123/204 |
| 4,626,182 | A | | 12/1986 | Wankel | 418/191 |
| 4,633,829 | A | | 1/1987 | Kollen | 123/246 |
| 4,683,852 | A | | 8/1987 | Kypreos-Pantazis | 123/228 |
| 4,702,206 | A | | 10/1987 | Harries | |
| 4,747,762 | A | | 5/1988 | Fairbairn | |
| 4,895,117 | A | | 1/1990 | Yang | |
| 5,071,328 | A | | 12/1991 | Schlictig | |
| 5,090,501 | A | * | 2/1992 | McNulty | 418/227 |
| 5,364,249 | A | | 11/1994 | Link | |
| 5,401,151 | A | | 3/1995 | Allen | |
| 5,466,138 | A | | 11/1995 | Gennaro | |
| 5,579,733 | A | | 12/1996 | Tour | |
| 5,816,789 | A | * | 10/1998 | Johnson | 418/227 |
| 6,065,874 | A | | 5/2000 | Tour | |

FOREIGN PATENT DOCUMENTS

| | | | |
|---|---|---|---|
| DE | 180927 | 2/1907 | 418/166 |
| DE | 3922574 C1 | 5/1990 | 123/248 |
| DE | 19606541 A1 | 7/1996 | |
| JP | 403130531 A | 6/1991 | 123/200 |
| WO | WO 83/00187 A1 | 1/1983 | F02B/41/00 |

* cited by examiner

*Primary Examiner*—Thomas Denion
*Assistant Examiner*—Thai-Ba Trieu
(74) *Attorney, Agent, or Firm*—Black Lowe and Graham PLLC

(57) ABSTRACT

A rotary machine having a housing with rotary components disclosed within. The rotary machine is configurable as an internal combustion rotary engine, an external combustion rotary engine, a gas compressor, a vacuum pump, a liquid pump, a drive turbine, or a drive turbine for expandable gases or pressurized liquids. The combustion engine employs a new thermal cycle—eliminating the Otto cycle's internal compression of the combustion products as part of the cycle. The new combustion thermal cycle is intake, expansion and exhaust.

9 Claims, 10 Drawing Sheets

ROTARY MACHINE AND THERMAL CYCLE

PRIORITY CLAIM

This application is a divisional of application Ser. No. 09/850,937 filed May 7, 2001 now U.S. Pat. No. 6,484,687.

FIELD OF THE INVENTION

This invention relates generally to rotary machines and more specifically to internal and external rotary combustion engines, fluid compressors, vacuum pumps, and drive turbines for expandable gases or pressurized fluid and water.

BACKGROUND OF THE INVENTION

As the human race has evolved throughout the centuries, we, as a people, have used our minds to develop machines and tools to help us achieve higher evolutionary standards. Technological advances include the invention and discovery of the lever and the wheel in early times to more sophisticated communication and computational devices that we now enjoy in our daily lives. Nearly all aspects of technology, from the very rudimentary to the very complex, have made great advances that have made the daily lives of the people and animals on this planet much easier. However, there is one invention that has been with us for a long time that has received little technological advancement despite its extremely important use in our daily lives.

A typical four-cycle internal combustion reciprocating engine powers nearly all vehicles on the face of the planet. Likewise, the same engine is employed to power boats, generators, compressors, pumps, and machines of all type and design. However, despite its widespread use, the internal combustion, or Otto cycle, engine or, in certain instances, a diesel cycle engine, has received very little technological advancement. The changes made to the engine have left the basic thermal cycle of the engine untouched.

The reciprocating motion of common internal combustion engines, Otto and diesel cycle, is an inefficient method of producing rotary power. A typical four-cycle engine requires four reciprocating motions for each unit of power it delivers. Initially, the engine has an intake and compression stroke, followed by combustion, expansion, and exhaust strokes. The reciprocating motion of the four-cylinder engine requires four inertial changes of the rotating mass of the pistons, connecting rods, and assembly—each change in inertia yielding a power loss to the system. Likewise, each complete cycle of the internal combustion engine requires four inertial changes for the associated valves, springs, lifters, rocker arms, and push rods, yielding additional total loss of the engine.

The mechanical complexity of the standard internal combustion engine adds to the design's overall inefficiency. A single cylinder four-cycle engine requires many moving parts, including a piston, piston pin, connecting rod, crank shaft, a plurality of lifters, push rods, rocker arms, valves, valve springs, gears, a timing chain, and a fly wheel. Each one of these parts increases the probability of engine failure due to fatigue or wear. Likewise, this large number of parts increases the amount of inertial mass that must change four times per cycle, reducing power produced by the system. Each moving part is subject to frictional loss between each relative part, adding to power loss. Further, it is expensive to manufacture and maintain equipment requiring such a large number of moving parts.

A typical four-cycle engine is a low torque, high r.p.m. machine. Because the relatively short throw of the crank arm yields a very low tortional moment, the Otto cycle engine requires a higher r.p.m. to achieve higher power ratings. More specifically, both Otto and diesel cycle engines achieve their highest internal pressure at approximately the lowest tortional moment in the piston cycle, top dead center. Thus, the engine cycle does not mate the engine's greatest potential to do work—highest internal pressure—with the engine's best ability to exploit that potential or convert it to power. Further, the torque moment is not constant. Rather, the torque moment is at approximately zero at top dead center, reaches its highest value at mid-stroke, and returns to zero at bottom dead center. By design, the highest internal pressure occurs when the piston is at approximately full stroke or extension. Therefore, a majority of the initial force generated during combustion is transmitted axially down the piston and connecting rod and is not transferred to rotational power. Only subsequently, as the tortional moment enlarges, is a majority of the expansive force converted into rotational power. The resulting structural requirements limit piston assembly design, increasing mass and limiting material choice. Further, transmissions are necessary to amplify the relatively low torque generated by the reciprocating motion, thus adding weight, cost, complexity and additional power requirements to the overall system.

The compression, and thus heating, of the original unit volume of combustion products leads to further power loss. Gas expansion is dependent upon the temperature of the gas prior to ignition—with all other variables held constant, a gas with a cooler ignition temperature will expand more than the same gas at a hotter ignition temperature, given the space to do so. Therefore, the heating of the fuel/air mixture by compression prior to ignition reduces the amount of expansion, and thus work, attainable during the subsequent expansion stroke. Likewise, the reciprocating design limits the combustion product's ability to do useful work because the expansion volume is not equal to the compression volume-combustion heats the gas, thus increasing the expansion volume beyond the initial volume. Thus, relatively high-pressure combustion gases are exhausted without performing any useful work.

The overall design of Otto, diesel, and other rotary engines is limited by cross-leakage at high pressure. More specifically, cross leaking is internal pressure loss due to overflow from the high-pressure side to the low-pressure side of the system while the pistons move throughout their stroke. Leakage generally occurs around the piston and the cylinder walls, exhaust and inlet ports, and between the cylinder head and the block. The excessive number of seals and connecting parts in other internal combustion engines creates cross-leakage liability. Therefore, the operating internal pressure range of the engines is greatly reduced.

Yet another limitation of current rotary engine technology is the internal combustion design of the engines. More specifically, current rotary engines are operable only as internal combustion engines. The current designs fail to allow for use as external combustion or external detonation cycle engines. Thus, the current state of rotary engine technology requires a considerably larger volume for expansion of the gases than is required with an external aspects of this invention.

A further limitation of current engine technology is a lack of design diversity. The extent of diversity for typical internal engines is limited by a need to drive a common crankshaft from a plurality of reciprocating motions. The engine design has developed little from standard in-line and v-type engine configurations. Even other rotary engine designs are singular in their rotary component arrangements.

Alternative piston arrangements, such as cross rotation, have not been explored. This limited design diversity prevents possible space-saving designs from being developed.

Another design limitation of the internal combustion engine is the singularity of its use. The internal combustion engine is operable only as an internal combustion engine. It is a power source converting chemical energy into mechanical energy, the mechanical energy being in the form of a rotating shaft. The internal combustion engine itself has no ability to function with detonation chambers other than the internal combustion chamber, such as, for example, a shaped charge or other detonation cycle device, some of which provide external combustion. Furthermore, the internal combustion engine itself is incapable of functioning as an air compressor, a vacuum pump, an external combustion engine, water pump, a drive turbine for expandable gas, or a drive turbine.

SUMMARY OF THE INVENTION

The present invention comprises a rotary machine capable of functioning as an internal or external rotary combustion engine, shaped charge or detonation charge rotary engine, fluid compressor, vacuum pump, or drive turbine for expandable gases or pressurized fluid and water. In accordance with some aspects of the invention, the rotary machine employs a generally toroidal-shaped housing that is cylindrical in shape at its perimeter. Disposed substantially within the toroidal housing and integrally connected to the housing is a plurality of rotary components, including an expansion ring having an expansion ring projection that cooperates with a sealing cylinder having a recess that mechanically mates with the expansion ring projection.

In accordance with other aspects of the invention, the invention includes intake and exhaust ports that, depending upon the function the rotary machine is performing, allow various gases, fuels, or fluids to enter or exit a chamber defined within the rotary machine.

In accordance with further aspects of the invention, when functioning as an internal combustion machine, combustion products entering the intake port are not compressed by the combustion chamber prior to ignition.

In accordance with other aspects of the invention, in some embodiments the expansion ratio is greater than the compression volume.

In accordance with still further aspects of the invention, the exhaust gases are exhausted at any desirable exhaust pressure, including ambient pressure.

In accordance with yet other aspects of the invention, the toroidal housing prevents pressure loss due to cross leaking.

In accordance with still further aspects of the invention, the torque moment is constant throughout the cycle, but the torque value decreases with decreasing pressure.

In accordance with still further aspects of the invention, the constant torque moment allows the rotary machine to operate at relatively low r.p.m. while achieving relatively high power output.

In accordance with yet other aspects of the invention, the highest torque moment coincides with the highest compression or internal pressure.

In accordance with yet other aspects of the invention, the torque value and r.p.m. are independent variables that may be manipulated to achieve a desired power output.

In accordance with still further aspects of the invention, the compression ratio is independent and may be adjusted to achieve a desired output.

In accordance with still further aspects of the invention, the relative motion of the piston and output shafts is adjustable to any configuration.

In accordance with yet other aspects of the invention, ignition timing is variable to achieve a desirable combustion pressure.

In accordance with still further aspects of the invention, a variety of ignition devices are employable with the rotary machine, for example, transformer discharge systems, voltage devices, spark plugs, photoelectric cell, piezoelectric and plasma arc devices.

In accordance with yet other aspects of the invention, the rotary machine produces bi-directional rotational power that may be employed separately or conjunctively.

In accordance with still further aspects of the invention, a plurality of rotary machines may be selectively employed to achieve a desired power output.

In accordance with yet other aspects of the invention, a plurality of rotary machines may be selectively employed to achieve a desired vacuum or compression value.

In accordance with yet other aspects of the invention, a new thermal cycle is developed having an intake, expansion and exhaust stroke, without compression of the combustion products within the combustion chamber.

In accordance with yet other aspects of the invention, in some embodiments combustion products are compressed prior to combustion.

In accordance with yet other aspects of the invention, the combustion and expansion chambers are shaped to allow efficient expansion of combustion products with minimal inertial loss.

In accordance with yet other aspects of the invention, piston size and torque moment are variable to achieve desired r.p.m. and power requirements.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Physical Description

Figure 1:
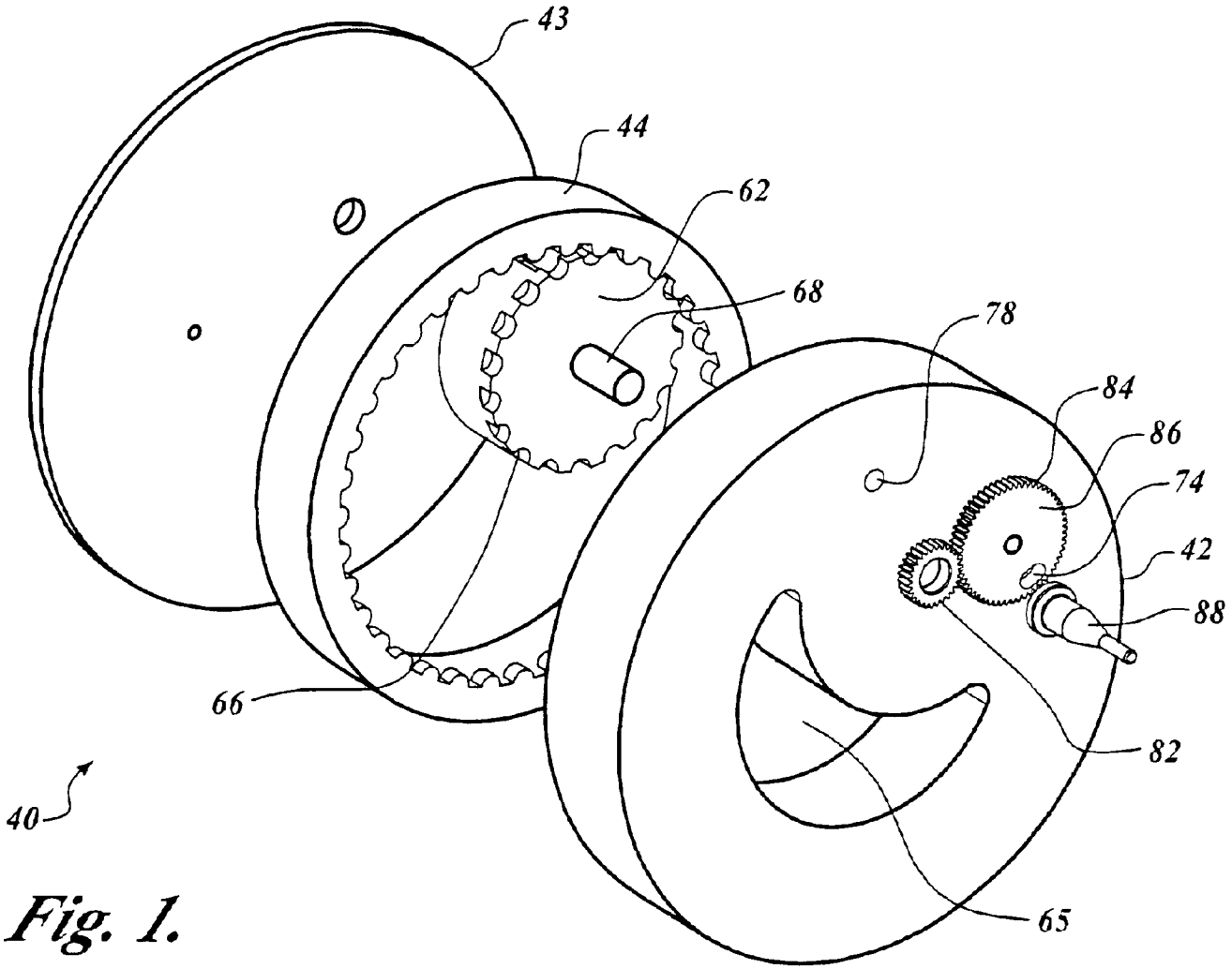
FIG. 1 is a semi-exploded isometric view of a rotary machine.

FIG. 1 depicts a preferred embodiment of a rotary machine 40. The rotary machine 40 employs a generally toroidal-shaped housing 42 having a cover 43 at one end. Disposed substantially within the toroidal housing 42 and integrally connected to the housing 42 is a plurality of rotary components. The generally toroidal-shaped housing 42 is substantially cylindrical in shape at its perimeter. However, at an end of the housing 42 opposite of the cover 43, the housing forms a generally toroidal inner housing 56 (see FIG. 2).

An expansion ring 44 is located within the housing 42 and the cover 43. More specifically, the expansion ring 44 is disposed between the toroidal housing 42 and the toroidal inner housing 56. The expansion ring 44 is generally cylindrical in shape, having disposed on a portion of its inner surface an expansion ring gear 46 (see FIG. 2). The expansion ring gear 46 and that corresponding portion of the expansion ring 44 are generally disposed within an expansion ring gear race 48 formed in the toroidal housing 42 (best seen in FIGS. 5–6). The race 48 provides a bearing surface for the expansion ring 44. The race 48 is a substantially cylindrical-shaped groove having a diameter slightly smaller than the diameter of the expansion ring gear 46. The depth of the race 48 is determined largely by the application employed by the rotary machine 40. In relatively high speed, low torque applications the race depth may be slightly greater than in a lower r.p.m. application. The guiding principle regarding race 48 design is to provide a guide track to help maintain the rotational movement integrity of the expansion ring 44.

The type of bearing (not shown) employed to carry relative motion of the rotary components varies with the application. In the preferred high speed, low torque embodiment roller bearings would be employed. However, other bearings are considered within the scope of this invention, for example, ball, tapered, air, liquid metal and magnetic bearings. Similarly, in a high torque, low speed application carbon (graphite) bushings are preferred. Again, however, other bearings are considered within the scope of this aspect of the invention, for example, ceramic composites, oil impregnated composites and bronzes, carbon impregnated composites, carbide composites and powdered metal composites.

Figure 2:
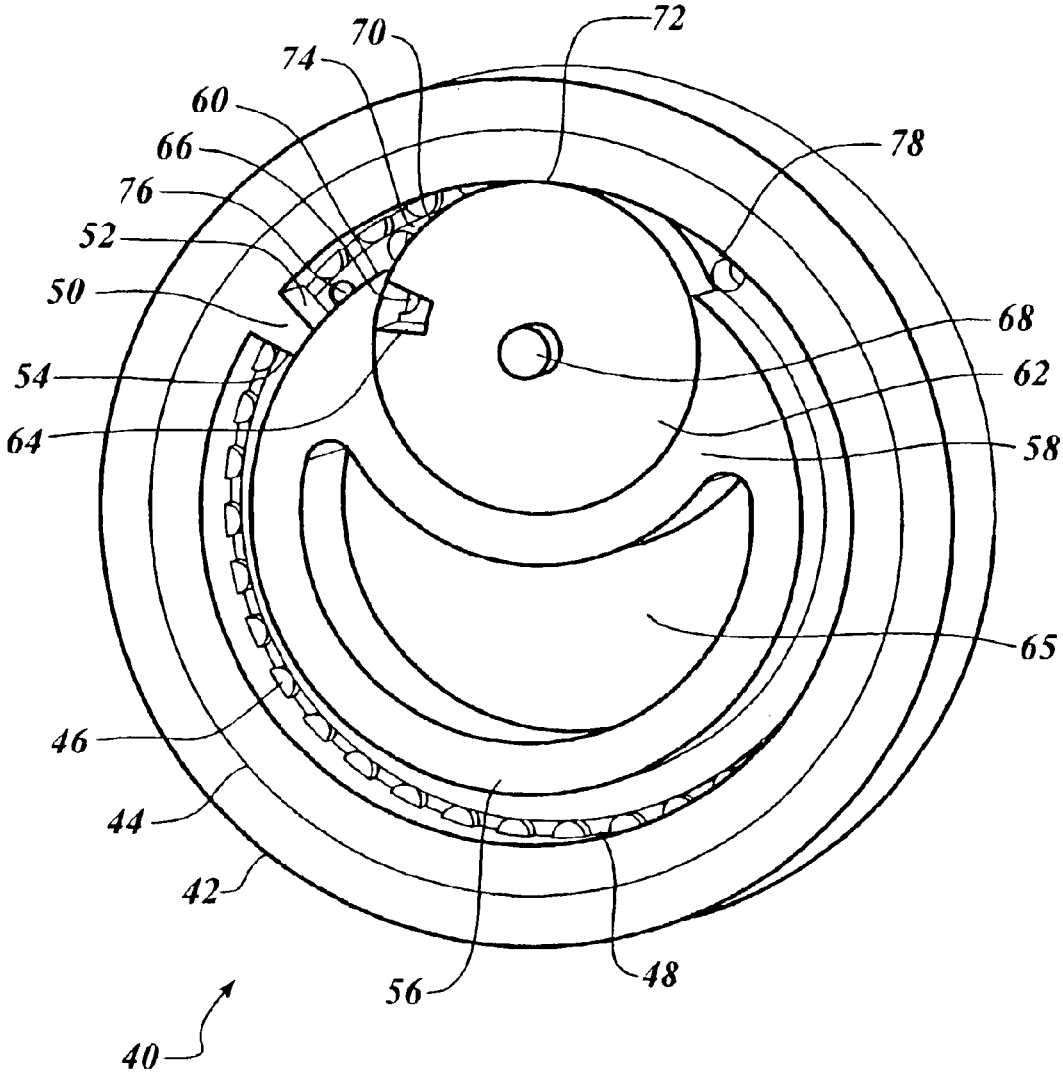
FIG. 2 is a sectional frontal view of rotary components.

Further, in the preferred embodiment, located on an inner surface of the expansion ring 44 is an expansion ring projection 50 (FIG. 2). The expansion ring projection 50 is radially formed on an inner surface of the expansion ring 44. The projection 50 extends substantially from an inner surface of the expansion ring 44 to the toroidal inner-housing wall 60 (FIG. 2). Additionally, disposed within the expansion ring 44, and consequently within the toroidal housing 42, is a sealing cylinder 62. The sealing cylinder 62 is mechanically connected to the expansion ring 44 via the expansion ring gear 46 and the sealing cylinder gear 66. In a similar manner as discussed above, the sealing cylinder gear 66 rides in a sealing cylinder race 67 (see FIG. 5). Also, the sealing cylinder 62 has located on its outer periphery, at an end opposite the sealing cylinder gear 66, a sealing cylinder recess 64 (FIG. 2). The sealing cylinder recess 64 is shaped and located to mechanically mate with the expansion ring projection 50 at designated intervals.

Other expansion ring 44 designs are considered within the scope of this invention. More specifically, the arrangement of the expansion ring within the housing may have the ring 44 located on an inward portion of the space 110 with the projection 50 extending outwardly (not shown). Likewise, the ring may be disposed approximately in the center of the space 110 with projections 50 extending inwardly and outwardly (not shown). Thus, any possible arrangement of ring 44 and projection 50 is considered within the scope of the invention.

The gearing relationship between the sealing cylinder 62 and the expansion ring 44 as well as the relative rotational movement of the rotary components are also adjustable. In the preferred embodiment, for relatively high torque applications a lower gear ratio is typically preferred. For example, a one-to-one ratio of sealing cylinder 62 and expansion ring 44 speed is desirable. Conversely, for relatively higher speed lower torque applications, a higher ratio may be employed, for example, one-to-ten expansion ring 44 to sealing cylinder 62 ratio may be used. The above ratios are examples of various ratios employable by this rotary machine, however, any other ratio is considered within the scope of this invention to achieve any desired output.

Another aspect of this invention is the variable relationship of the rotary components. In the preferred embodiment shown in the FIGURES, the ring 44 and cylinder 62 rotate in the same plane. However, other mechanical connections may be employed to permit rotation of the ring 44 and cylinder 62 in different planes. Various gearing combinations (not shown) or other mechanical means commonly known in the art, may be employed such that rotation of the ring 44 may occur is planes other than the plane of rotation employed by the cylinder 62.

In the preferred embodiment, the sealing cylinder 62 has at its cylindrical axis a sealing cylinder projection 68 extending axially outward from each end of the sealing cylinder 62. The sealing cylinder projections 68 extend outside of the toroidal housing 42 and the cover 43 to provide both clockwise and counterclockwise rotation outside of the rotary machine 40. In an alternative embodiment, the projection 68 may extend from only one side of the sealing cylinder 62. In this manner, a more compact rotary machine 40 can be built, or specific rotational power can be achieved.

In the preferred embodiment, the sealing cylinder projection 68 that extends through the toroidal housing 42 also controls the valve port 86 opening timing. The valve port opening timing is controlled via a high-speed gear 82 and a low-speed geared valve 84. The high-speed gear 82 is joined to the projection 68 and rotates with rotation of the projection 68. Also connected to the high-speed gear 82 is the low-speed geared valve 84, which has a valve port 86 disposed therethrough. Further, disposed through a surface of the housing 42 and in an area encompassed by the geared valve 84 is an intake port 74 (FIG. 2). The rotation of the geared valve 84 via the high-speed gear 82 causes an intermittent alignment of the valve port 86 and the intake port 74, allowing introduction of combustion products.

Further disposed on a surface of the housing 42 is an ignition device 88, which is integrally connected with an ignition port 76 (see FIG. 2). The preferred embodiment employs a spark plug as a ignition device 88. However, any other ignition device 88 commonly known in the art is employable with this device. For example, transformer discharge systems, voltage devices, photoelectric cells, piezoelectric, and plasma arc devices are within the scope of this invention. Also, disposed through a surface of the toroidal housing is an exhaust port 78.

The ignition port 76 (see FIG. 2) is relatively spaced to the intake port 74 to provide efficient interaction of the ignition and intake products. As disclosed in the various FIGURES, the ignition port 76 is located in a rotationally counterclockwise position relative to the intake port 74. In the preferred embodiment the inlet port spacing is as near the sealing cylinder 62 as possible, including overlapping the sealing cylinder 62. In alternative embodiments, however, it is recognized that the relative positions of the intake port 74 and the ignition port 76 may vary. Also, the ports may be of any size or shape, for example, the ports may be round, square, triangular or oval. The relative size of the ports is dependent upon the time available for mass transfer to occur and the amount of mass transfer necessary in a given application. A plurality of ports may also be employed to achieve desired operating conditions. Further, the relative ports may be employed at an angle relative to the surface of the chamber (not shown). In this manner the intake and ignition products are propelled in an advancing direction with the expansion ring 42.

Yet another design consideration of this invention is material choice. In the preferred embodiment the rotary machine 40 is constructed of high temperature steel or any steel alloy. However, other materials are considered within the scope of this invention, for example, titanium, nickel and nickel alloys, carbon based composites, carbide composites, powdered metal composites, ceramics, ceramic composites, ferrous and non-ferrous metals.

FIG. 2 further discloses the relationship of the variety of components of the rotary machine 40. Bearing surfaces on an inner surface of housing 42 support the expansion ring 44. As stated above, a portion of the expansion ring 44 and the expansion ring gear 46 are supported by the expansion ring race 48 in the toroidal housing 42. The inner surface of the expansion ring 44 and the sealing cylinder wall 70 and a substantially toroidal housing wall 60 and projection trailing edge 52 define an inner space 71. Located within the inner space 71 are the intake port 74, ignition port 76 and exhaust port 78.

Extending radially across the inner space 71 is the expansion ring projection 50. The inner edge of the expansion ring projection 50 and the toroidal inner housing wall 60 form a movable, substantially airtight seal therebetween. Further, the sealing cylinder wall 70 is substantially in sealable contact with the expansion ring 44 at the contact area 72. The contact area 72 forms a substantially sealed separation between the intake port 74 and the exhaust port 78.

The toroidal inner-housing wall 60 bearingly supports the sealing cylinder 62 via a substantially c-shaped toroidal inner housing cutout 58. The c-shaped toroidal inner housing cutout 58 provides support for rotating sealing cylinder 62. As discussed above, a sealing cylinder race 67 is formed in the relative portion of the inner housing wall 60 of the inner housing cutout 58, wherein the sealing cylinder race 67 provides rotational stability for the sealing cylinder 62.

The inner housing cutout 58 and the sealing cylinder wall 70 are spaced relative to one another such that free rotation of the sealing cylinder 62 is allowed while providing a substantially airtight seal between the cylinder 62 and housing 58. Similarly, the points or terminal ends of the cutout 58 extend peripherally around the sealing cylinder 62 to points beyond the intake and exhaust ports, 74 and 78 respectively. In this manner, the geometry of the inner housing cutout 58 helps seal the space between the housing 58 and the sealing cylinder 62.

A removed area 65 is also shown. The removed area 65 serves a plurality of functions. First, the removed area decreases the overall weight of the rotary machine 40, which serves to increase the power-to-weight ratio of the machine 40. Also, the removed area 65 serves to increase the surface area of the machine 40, thus increasing the heat transfer capabilities of the machine 40 thereby allowing the machine 40 to operate at cooler temperatures. The removed area may be of any geometric shape. For example, oval, circular, lobed or other geometries are within the scope of this disclosure. Furthermore, cooling fins, or tubes, (not shown) may be disposed within the removed area 65, thus further increasing the rotary machine's cooling ability.

As discussed above, all prior rotary engines have suffered from side-sealing problems, with pressurized gases leaking around the ends of the drive rotor cylinder. The leakage is an overall energy loss to the system adversely effecting the efficiency of the engine. The removed area in combination with the toroidal housing 42 shape prevents any cross leaking from high-pressure area to a low-pressure area. The toroidal housing design effectively removes the ends, thereby making side-sealing problems an impossibility.

Figure 3:
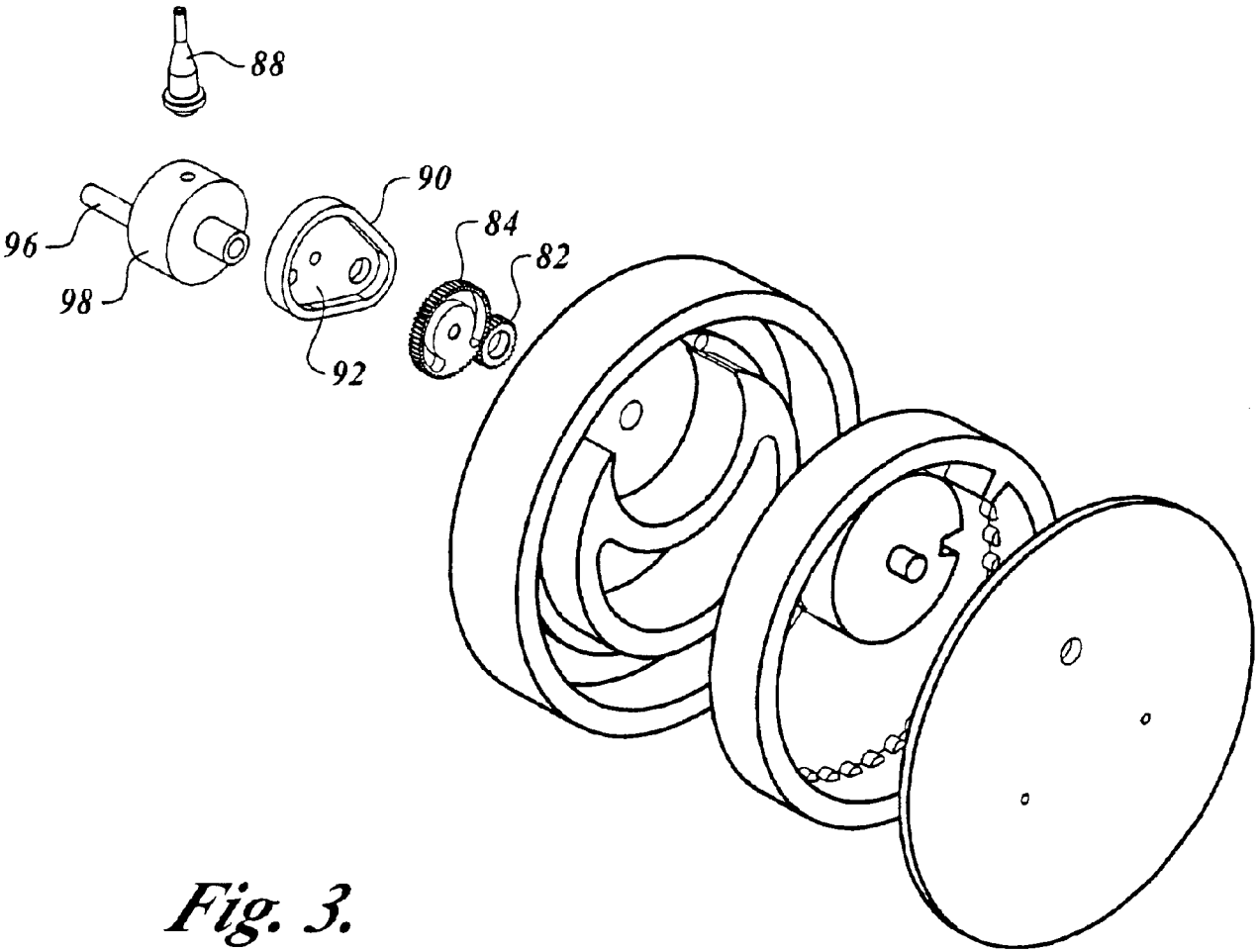
FIG. 3 is an exploded isometric view of the external combustion aspect of the invention.

FIG. 3 depicts the rotary machine 40, employed as an external combustion engine. Located on an end opposite of the cover 43 are external combustion components. The external combustion components are mechanically and fluidly integrated with the rotary machine 40. Extending over, and substantially enveloping the intake port 74 (see FIG. 2), high-speed gear 82 and geared valve 84 is a manifold and drive valve cover 90. On an external surface of the manifold and drive valve cover 90 is a manifold firing inlet 92. The manifold firing inlet 92 is mechanically and fluidly connected to an external combustion chamber 94. The external combustion chamber 94 is integrally connected with an ignition device 88 and a fuel/air admission device 96.

The rotary machine may include a plurality of external combustion chambers 94. For example, a manifold 90 may be employed to receive expanding combustive products from several external combustion chambers. The multi-combustion manifold (not shown) is designed to direct the combined combustive products through the intake port 74 in a manner similar to the single external combustion embodiment of this invention. However, with the multi-combustion chamber embodiment, the manifold shapes the respective shock waves produced, such that the respective waves substantially cancel themselves. The overall effect of the multi-combustion chamber embodiment is an increased internal pressure within the increasing space 110 relative to the single combustion chamber embodiment. More specifically, the plurality of external combustion chambers function to increase the overall volume of expansive gases, and thus internal pressure of the rotary machine 40.

Figure 4:
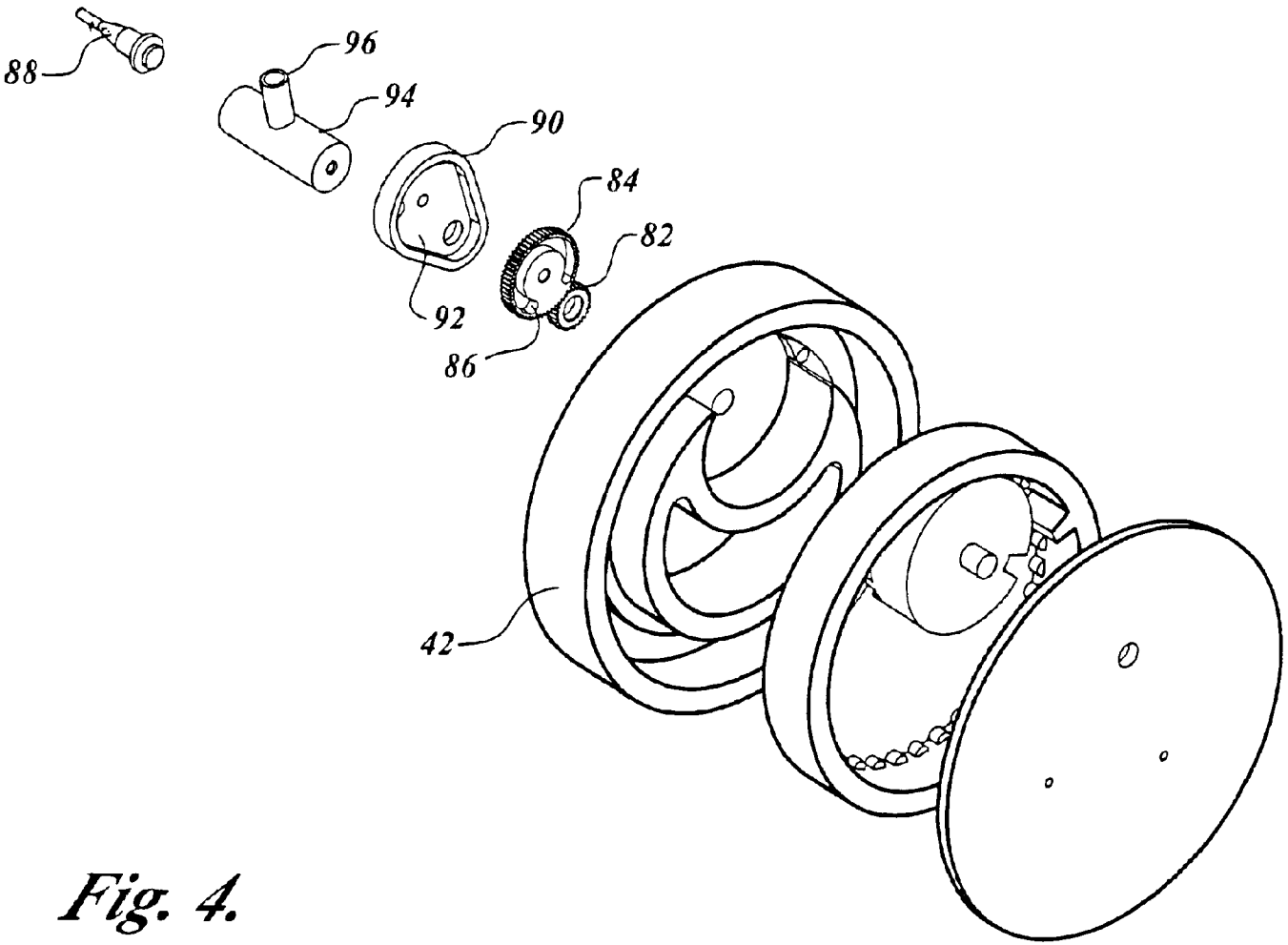
FIG. 4 is an exploded isometric view of the shaped charge or other detonation cycle external combustion aspect of the invention.

FIG. 4 depicts an alternate embodiment of an external combustion rotary machine 40. In this embodiment, the external combustion chamber 94 is replaced with a shaped charge or other detonation cycle chamber 98. The shaped charge or other detonation cycle chamber 98 comprises at least one each of a fuel/air admission device 96 and an ignition device 88. In this aspect of the invention, a shaped compression wave or pulse compression wave is propagated within the cycle chamber 98 and fluidly transported into the toroidal housing 42 to produce work from the rotary machine 40. Though one shaped charge or other detonation cycle chambers 98 is shown in FIG. 4, as with the external combustion chamber embodiment, the use of several shaped charge chambers 98 is within the scope of this invention.

The general shape of either the external combustion chamber 94 or the detonation cycle chamber 98 is variable and either may be of any internal or external geometry. The general shape of either chamber may be manipulated to achieve a desired pressure or some other desired nature of the pressure or compression wave.

Figure 5:
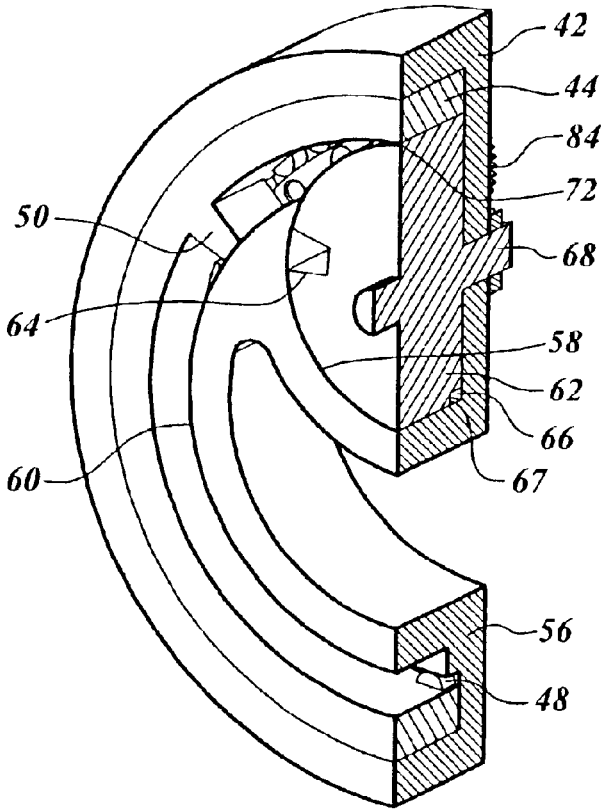
FIG. 5 is a sectional isometric view taken along line 5—5 of FIG. 2, of some rotary components.

FIG. 5 depicts a sectional view of the rotary machine 40. As seen in FIG. 5, the housing 42 surrounds and is in bearing contact with the expansion ring 44. Likewise, the expansion ring projection 50 is in substantially sealing contact with the inner housing wall 60. Additionally, the sealing cylinder 62 is nested in the c-shaped inner housing cut-out 58 and is in sealing bearing contact with the expansion ring 44 at the sealing cylinder contact area 72. The sealing cylinder projections 68 are disclosed as extending from respective axial surfaces of the sealing cylinder 62. The projections 68 extend through the housing 42 and cover 43, respectively.

Figure 6:
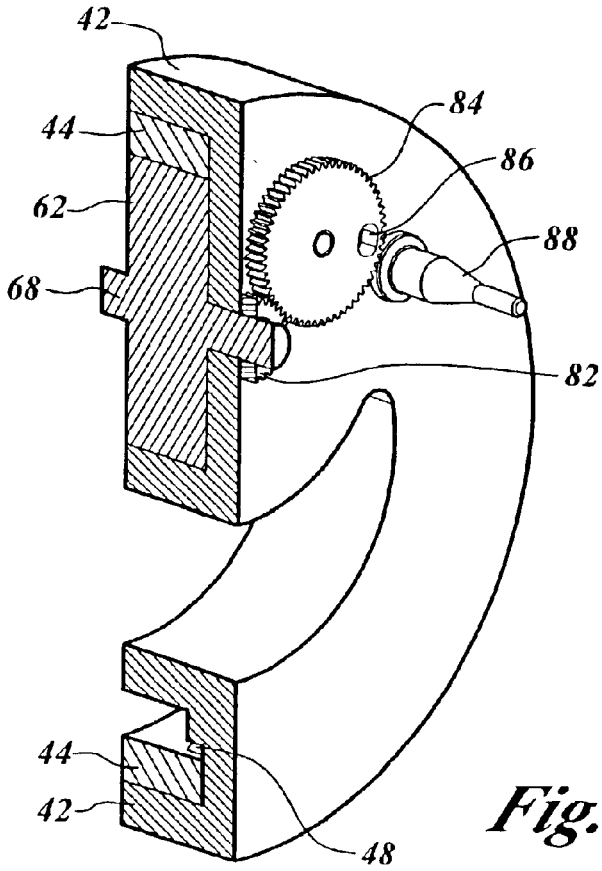
FIG. 6 is a sectional isometric view taken along line 6—6 of FIG. 1, of some rotary components.

FIG. 6 is an additional sectional view of a portion of the rotary machine 40. The high-speed gear 82 is attached to a sealing cylinder projection 68. The high-speed gear 82 is mechanically connected to the geared valve 84. Depending upon the application, the high-speed gear 82 and the geared valve 84 function as either the drive gear or the driven gear. For example, when the rotary machine is employed as an internal combustion engine, the expansion ring 42 and sealing cylinder are driven in a counterclockwise manner as a result of combustion. The rotation of the sealing cylinder 62 yields a rotation of the projection 68 that drives the rotation of the high-speed gear 82. The high-speed gear 82, as the drive gear, transfers the rotational displacement to the geared rotary valve 84, thus controlling the valve port 86 timing. Conversely, when the rotary machine 40 is employed as a fluid pump, the geared valve 84 controls the introduction of the fluid and thus, control of the valve action dictates the relative movements of the internal components. Thus, the geared valve 84 drives the high-speed gear 82.

Figure 7:
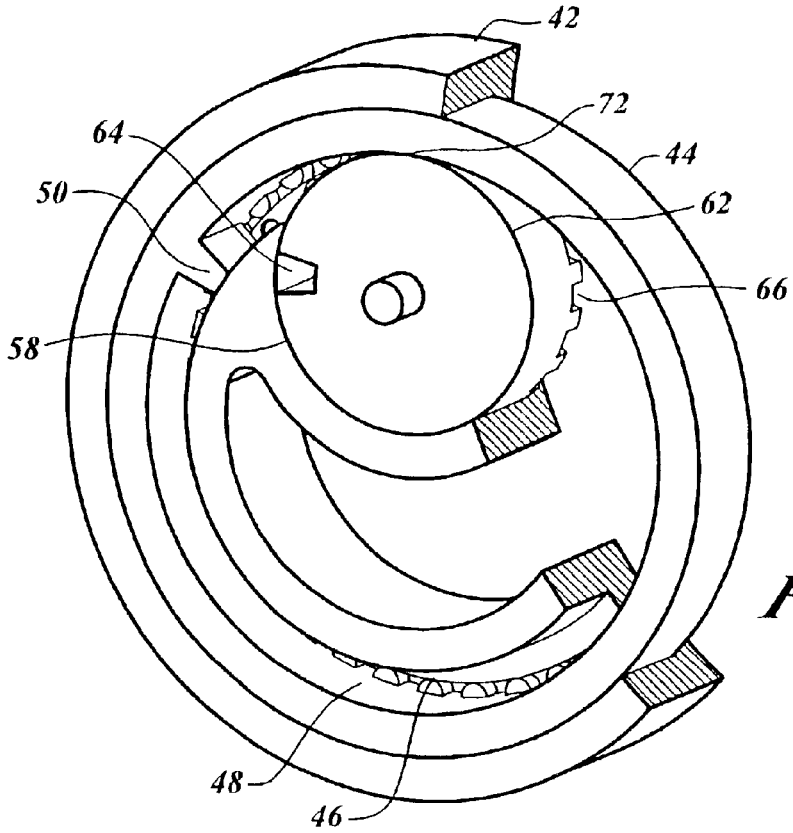
FIG. 7 is a sectional isometric view taken along line 7—7 of FIG. 2, of some rotary components.

FIG. 7 provides another view of the bearing relationship between the toroidal housing 42 and the expansion ring 44. In a similar fashion, the bearing relationship between the sealing cylinder 62 and the inner-housing cutout 58 is illustrated. The expansion ring gear 46 and a portion of the expansion ring 44 are maintained in the expansion ring race 48. The expansion ring race, in combination with the inner wall of the toroidal housing 42, maintains the disposition of the expansion ring within the housing while permitting free rotary motion of the ring 42. A similar relationship exists between the inner housing cutout 58, sealing cylinder 62 and expansion ring 44.

Figure 8:
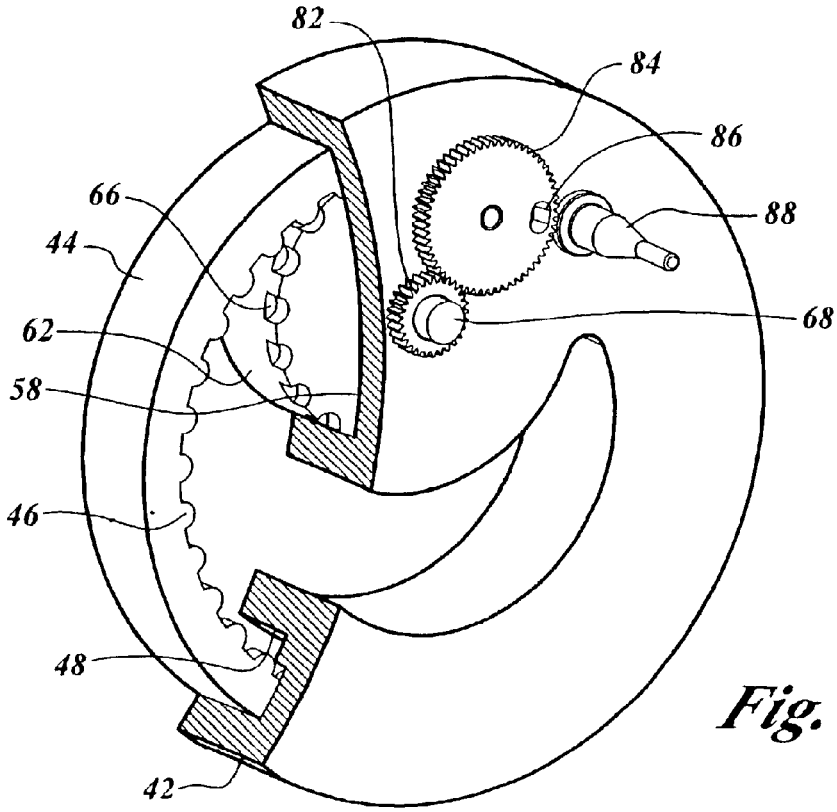
FIG. 8 is a sectional isometric view taken along line 8—8 of FIG. 1, of some rotary components.

FIG. 8 further discloses the mechanical relationship between the sealing cylinder 62, expansion ring 44, high-speed gear 82, geared valve 84 and valve port 86. Relative motion between the expansion ring 44 and the sealing cylinder 62 is transmitted between the two components via the expansion ring gear 46 and sealing cylinder gear 66, respectively. Likewise, any rotary motion of the sealing cylinder 62 is transmitted to the geared valve 84 via the sealing cylinder projection 68 and high-speed gear 82. As a result, the timing of the opening and closing of the valve port 86 is coupled with the relative orientation of the sealing cylinder 62 and the expansion ring.

Figure 9:
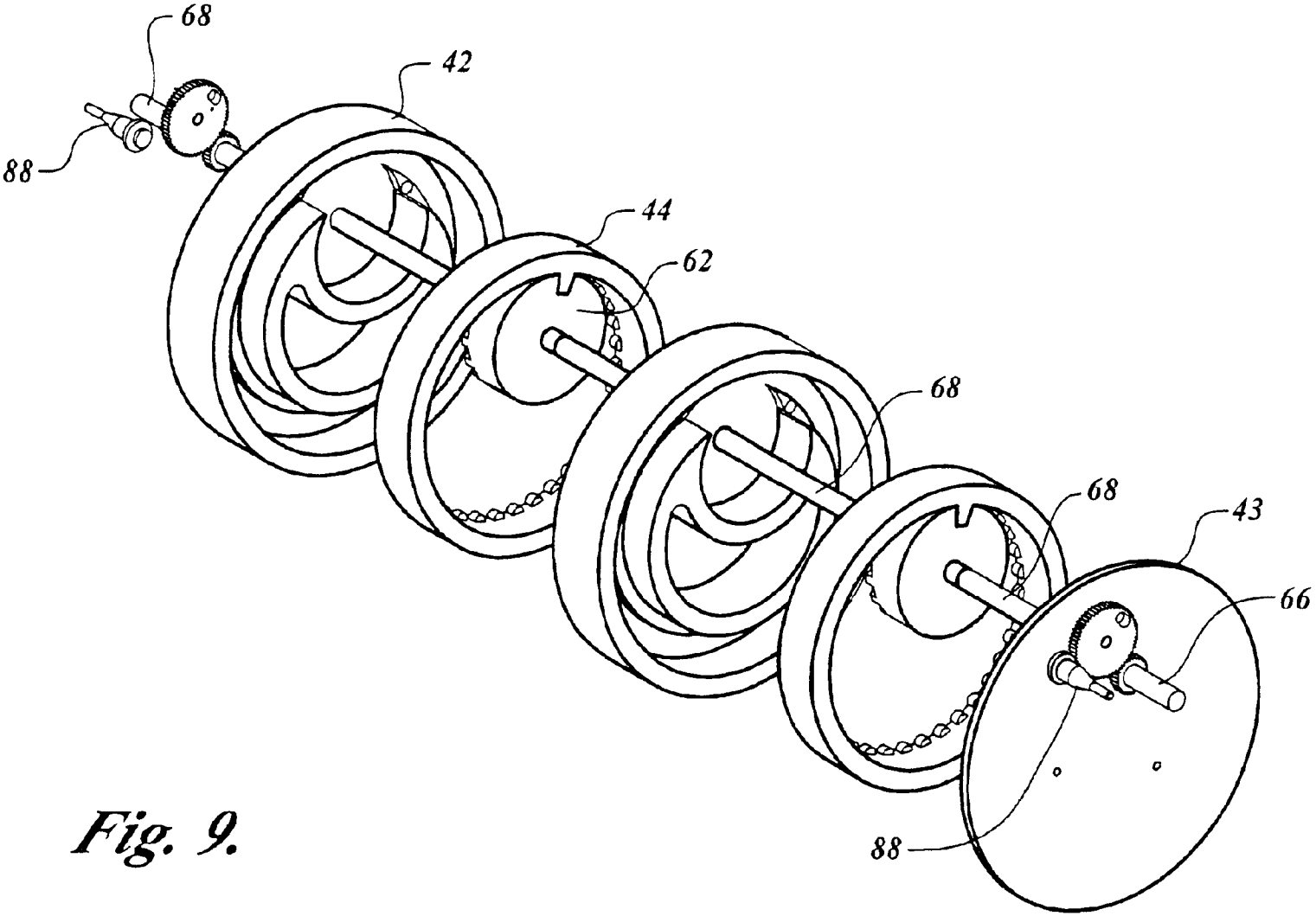
FIG. 9 is a isometric view of a multi-cylinder aspect of the invention.

FIG. 9 depicts a multi-cylinder embodiment of this invention. This aspect of the invention discloses multiple cylinders disposed upon common axis, such as a single sealing cylinder projection 68. In this manner, any number of cylinders can be joined to attain a desired power output.

The multi-cylinder embodiment of this invention anticipates a plurality of operating states. For example, a four cylinder rotary machine is operable with one, two, three or all four cylinders firing—the firing state being a function of the power requirement. The cylinders not firing are in a freewheel mode wherein their mass simply increases flywheel mass, and thus the angular momentum of the rotary machine.

Figure 10:
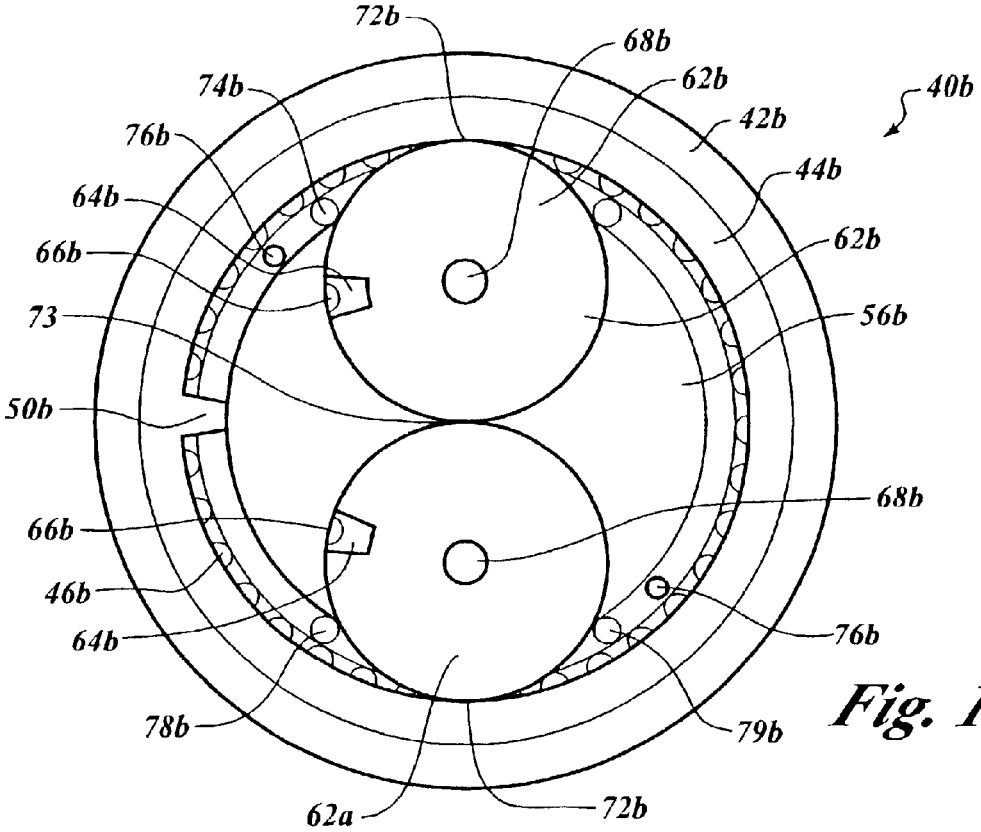
FIG. 10 is a frontal view of a multi-firing aspect of the invention.

FIG. 10 depicts a rotary machine 40(*b*) with multiple cycles per expansion ring 44(*b*) rotation. The interrelationship of the various components of this embodiment is substantially the same as the single firing per expansion ring 42 rotation discussed above.

This embodiment depicts two firing cycles per revolution of the expansion ring 44(*b*). In the preferred embodiment, this is accomplished by substantially similar sealing cylinders 62(*a*) and (*b*) traversing the internal diameter of the expansion ring 44(*b*). The sealing cylinders are mechanically connected to each other and the expansion ring via a sealing cylinder gear 66(*b*) and expansion ring gear 46(*b*). Each respective sealing cylinder 62(*b*) forms a contact area 72(*b*) with the expansion ring 44(*b*). The contact areas 72(*b*) divide the rotary machine 40(*b*) into substantially equal work-producing areas. Each work-producing area comprises an intake port 74(*b*), ignition port 76(*b*) and exhaust port 78(*b*). A full thermal cycle takes place in each work-producing area, producing two expansion or power strokes per expansion ring revolution.

In the preferred embodiment depicted in FIG. 10, the firing of the ignition devices (not shown) is sequential. Thus, when the expansion ring projection 50(*b*) reaches a counterclockwise position relative to each ignition port 76(*b*), an ignition takes place. The expanding combustive products drive the expansion ring 44(*b*) until they exit through exhaust port 78(*b*). The expansion ring projection 50(*b*) then passes through mated contact with the sealing cylinder recess 64(*b*) and into a second ignition position.

It is anticipated that the expansion ring 44(*b*) may have a plurality of expansion ring projections 50(*b*), thereby permitting simultaneous ignition of the combustion products. Further, it is within the scope of this invention to further increase the number of work producing areas within a single expansion ring 44(*b*) rotation. For example, a third or fourth sealing cylinder may be introduced to increase the number of work-producing areas correspondingly.

Cycles

Internal Combustion Engine

This invention creates a new thermal cycle for engines. The new cycle is intake, power and exhaust. Thus, the new thermal cycle does not have a compression stroke robbing power from the system while simultaneously limiting the work produced by preheating the initial charge. Likewise, the cycle allows for full gaseous expansion during the power stroke by exhausting gases at or slightly above atmospheric pressure. Thus, nearly all power loss is removed while maximizing the work produced by the cycle.

Listed below is a more detailed description of various aspects of the new engine cycle. Further, following the internal combustion aspect of this invention, additional aspects of this invention are disclosed in detail.

Figure 11:
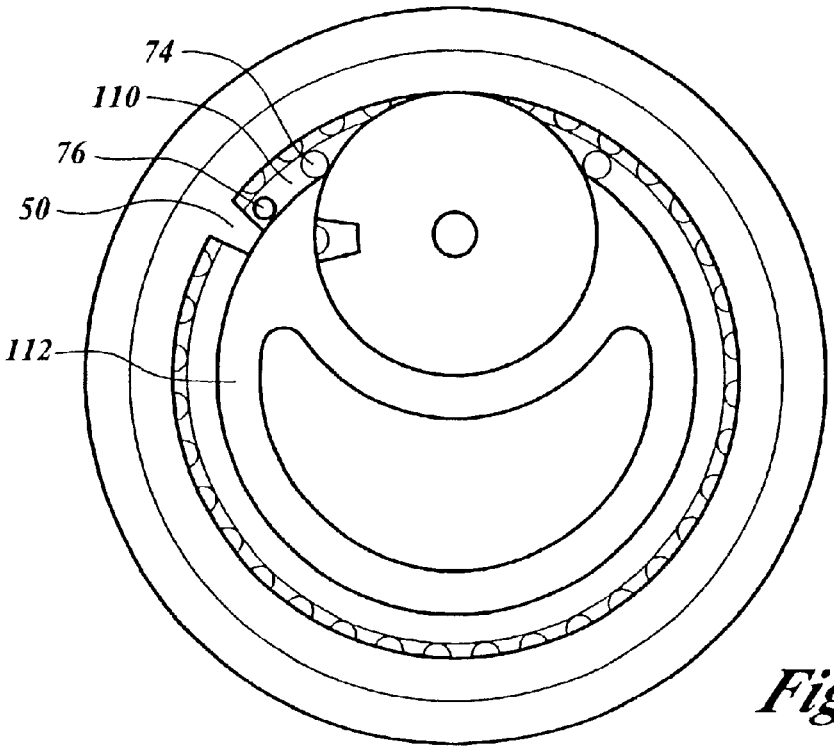
FIG. 11 is a frontal view of a state in the rotary cycle.

FIG. 11 discloses the rotary machine 40 at an approximate intake state in the engine cycle. The expansion ring projection 50 is shown counterclockwise past the intake port 74 and ignition port 76 to define a space 110 and space 112. As the ring projection 50 moves counterclockwise, a plurality of precisely timed events take place. The sealing cylinder 62 is rotationally displaced, which ultimately controls the rotation of the geared valve 84. At a dedicated time (discussed below), the rotation of the geared valve 84 brings into alignment the valve port 86 and the intake port 74. As alignment is achieved, the combustion products are introduced into the space 110 and subsequently ignited by the ignition device 88.

The combustion products are introduced into the space 110 either at atmospheric pressure or at a compressed state. In the preferred embodiment, the combustion products are introduced at between one to twenty-five atmospheres. However, any other combustion product pressure is considered within the scope of this invention. When combustion products are introduced at atmospheric pressure, or without pre-compression, they are simply drawn into the space 110 by a vacuum created by the counterclockwise displacement of the expansion ring 44. The overall efficiency of the rotary machine 40 is slightly decreased when combustion products are introduced at approximately ambient pressure. However, when operated in this mode, the intake port 74 is larger in diameter, thereby decreasing the flow resistance and permitting maximum fluid transport into the space 110. In a similar manner, the valve port 86 may be of slightly increased size, allowing a slightly longer intake cycle.

Pressurized combustion products can also be introduced into the space 110. In the preferred pressurized embodiment, a fuel pump pressurizes the combustion products. However, any other commonly known means for pressurizing fluids is within the scope of this invention. The overall process of introducing the combustion products into the space 110 is substantially the same as discussed above. However, as the combustion products are being introduced under pressure, the positive pressure of the combustion products drives the fluid transfer into the space 110, not a negative pressure created within the space 110 as above. Also, the rate at which the fluid transfer occurs is generally quicker than the vacuum induction embodiment discussed above. Thus, the relative size of the valve port 86 is preferably smaller than the valve port 86 dimensions used in the above embodiment.

The inlet air may be pressurized by a fan, blower, or super charger (not shown) to accommodate higher cycle speeds and combustion pressure. The power to operate these devices may be drawn from the rotation of the sealing cylinder projection 68, by manipulation of the exhaust gases (discussed below) or by other means commonly known in the art. Distinct from the Otto cycle engines, the pressurization of the combustion products does not take place within the combustion area, or space 110; the pressurization is created externally. In this manner, piston momentum is not lost in the pressurization process, therefore yielding a more efficient engine cycle.

In yet another preferred embodiment, a combination of fuel and air may be mixed internally, within space 110, by drawing air only through the intake valve and injecting fuel directly into the space 110 by use of a direct cylinder injector (not shown). This combination of pressurized injection of fuel and vacuum-induced air has additional advantages over other embodiments. The ratio of fuel to air may be manipulated to achieve a desired combustion rate. The ratio may be manipulated by adjusting port sizes or injection pressures and ignition timing (discussed below). By mixing the combustion products in the space 110, the possibility of intake manifold fires is eliminated.

The angle of the axis of the intake port 74 relative to the expansion ring's 44 cylindrical axis may be varied to provide additional rotational encouragement of the expansion ring 44. More specifically, in either the vacuum induction embodiment or the pressurized embodiment discussed above, the intake port may be angled such that the combustion products are directed into the trailing edge of the expansion ring projection 50 (angled ports not shown). In the pressurized embodiment, by directing the combustion products in the direction of rotation, the majority of the combustion products, and thus the greatest resulting combustive pressure wave, is generated as closely as possible to the projection 50. Thus, the combustion more efficiently transfers the resulting chemical energy of the combustive products into mechanical energy via the expansion ring 44.

In the preferred embodiment, the valve means is a rotary geared valve 84. However, other valve means are considered within the scope of this invention, for example, solenoid controlled, poppet, slide, flapper, disc, cam actuated, drum, reed, desmobromic cam, gate, check and ball valves. Regardless of the style of valve employed, the valve must operate to efficiently transfer fluids into the space 10. The valve choice is largely determined by the application of the rotary machine 40, such as faster acting valves for higher speed applications.

At the rotary state approximated by FIG. 11, combustion products are introduced into the space 110. The precise timing of the combustive product introduction is controlled by the valve, however, the overriding valve design is controlled by the relative intake and the expansion volumes—the expansion ratio. More specifically, as disclosed in FIG. 1, the ratio between the volume of combustive products introduced into space 110 and the expansion value possible through space 112 defines the expansion ratio. In the preferred embodiment, an expansion volume that is approximately 3–4 times the intake volume is optimal. This allows nearly complete expansion of the combustive gases, thus maximizing the work performed by the combustion process. However, independent selection of expansion ratios within the scope of this invention. In this embodiment, the combustive products are exhausted at approximately ambient pressure. However, as it is sometimes desirable to have slightly pressurized exhaust gases, the expansion ratio can be manipulated to achieve a desired exhaust gas state.

At a controlled time after the introduction of the combustion products, the intake port 74 is closed and the ignition device 88 fires the combustion products in the increasing space 110. The resulting combustion greatly increases the pressure within the increasing space 110, which forces the expansion ring projection 50 away from sealing cylinder 62, beginning the power stroke.

The timing of the combustion product ignition is also a variable to be manipulated to achieve specific rotary machine 40 efficiency. For example, ignition early in the intake process corresponds with a relatively smaller space 110, thus a higher initial combustive pressure within the space 110 is attained as well as a slightly higher expansion ratio. Conversely, when the rotary machine 40 ignition is set at a time further advanced in the cycle, a larger space 110 exists. Thus, for an identical machine, a lower combustive pressure is attained and a slightly smaller expansion ratio is attained.

The ignition timing is also based on the relative location of the intake port 74 and ignition port 76. In all embodiments, the ignition port is in the rotational direction away from the intake port. In this manner, the combustion products, whether pressurized or not, flow over the ignition port 74. In a preferred embodiment, the ignition is timed to fire approximately in the middle of the combustive products as the combustive products pass over the ignition port 74. In this manner, a more complete initial combustion takes place, providing a relatively faster pressure increase. However, the timing may be set to fire at approximately the leading edge of the combustive products, or perhaps the trailing edge of same. In each case a slightly different combustion rate is achieved, yielding varying internal pressures. Further, the ignition timing is preferably continually adjustable during operation of the rotary machine 40. More specifically, the timing may be advanced or retarded based on engine speed or loading requirements.

The ignition timing and relative port location, design and size allow for the combustion product volume to be independent from sealing cylinder projection 68 r.p.m. requirements. More specifically, as discussed above, gearing relationships may be employed to yield a projection 68 velocity independent of the volume of the combustive charge employed. In this manner, the specific combustive charge volume is independent of the size of the engine. Also, the relative speed of the expansion ring 44 and the projection 68 may be manipulated to achieve any desirable relative speed between the two components.

The chemical composition of the fuel also affects performance of the rotary machine 40 and thus the timing of the valve means and the ignition means. Different fuels have different combustion rates. Therefore, the relative timing of the valve means and ignition means will vary to optimize efficiency. The preferred embodiment employs gasoline as a fuel source. However, any other fuel commonly known in the art is employable with this device. For example, hydrogen, methane, propane, kerosene, diesel, butane, acetylene, octane, fuel oil, all explosive gases or combustible liquids, carbon cycle fuels (as dust), combustible metals (as dust) and others are within the scope of this invention.

Figure 12:
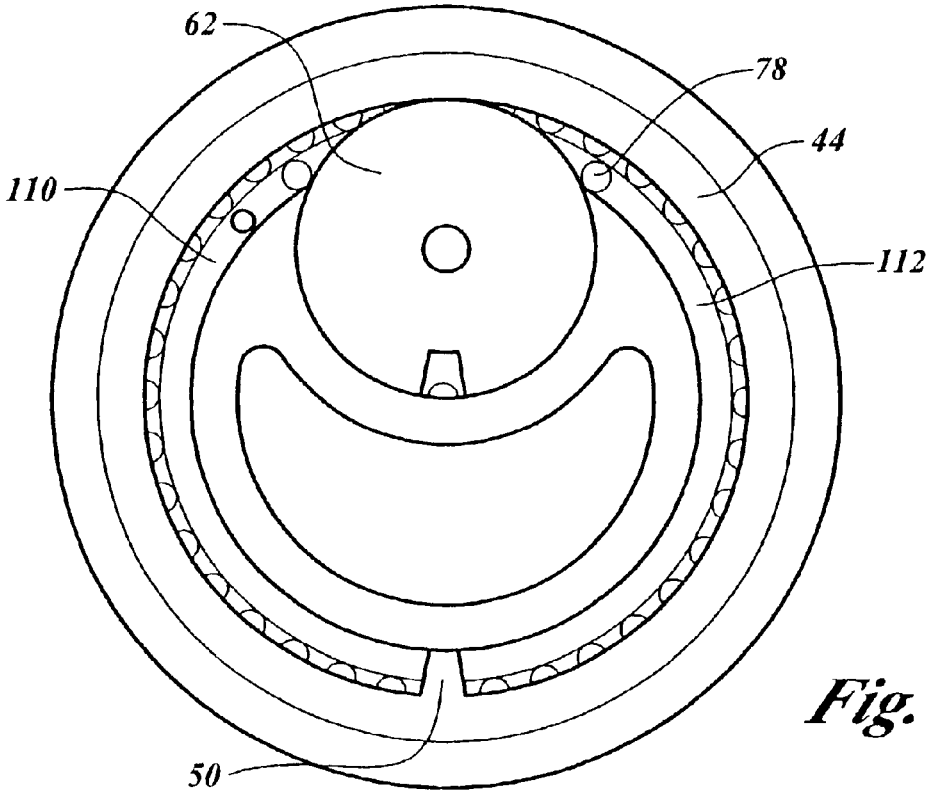
FIG. 12 is a frontal view of a state in the rotary cycle.

FIG. 12 shows the expansion ring 44 and the inner sealing cylinder 62 each rotated in a counterclockwise direction due to the combustion related pressure increase within the increasing space 110. During the power state, the internal pressure within the increasing space 110 decreases with the increasing volume of the space 110. As the expansion ring 44 rotates, the sealing cylinder 62 is likewise driven in a counterclockwise direction. Thus, the projection 68 rotates and yields a rotational power source outside the housing 42.

An even and consistent expansion of the combustive products is desired in the preferred embodiment of this invention. Generally, even expansion, or a controlled oxidation rate, is achieved through control of the timing of ignition, composition of the fuel and the relative locations of the intake port 74 and ignition port 76 as discussed above. However, other design aspects of this invention are utilized to maximize efficient use of the combustive gases, for example, geometric design of the combustion and expansion space 110.

The geometric design of the space 110 where the combustion takes place, and consequently the geometry of the projection 50, is shaped to maximize the conversion from chemical to mechanical energy. More specifically, the preferred embodiment as shown in the FIGURES discloses the space 110 as generally a cylindrical hoop within the housing 42. The hoop structure is designed to allow not only a smooth entrance and dissipation of combustion products, but also a minimally restrictive expansion area. The smooth expansion area of increasing space 110 encourages an efficient rate of propagation of the flame during ignition and a desirable swirling of the gases during expansion. The monodirectional rotation of the expansion ring 44 and the relatively smooth inner surface of the space 110 minimize inertial loss of the expanding combustive products. Additionally, the geometry of the preferred embodiment prevents power-robbing multiple detonations during a single cycle by allowing smooth fluid transfer during combustion. Any other geometry for the space 110 and projection 50 is considered within the scope of this invention.

Figure 13:
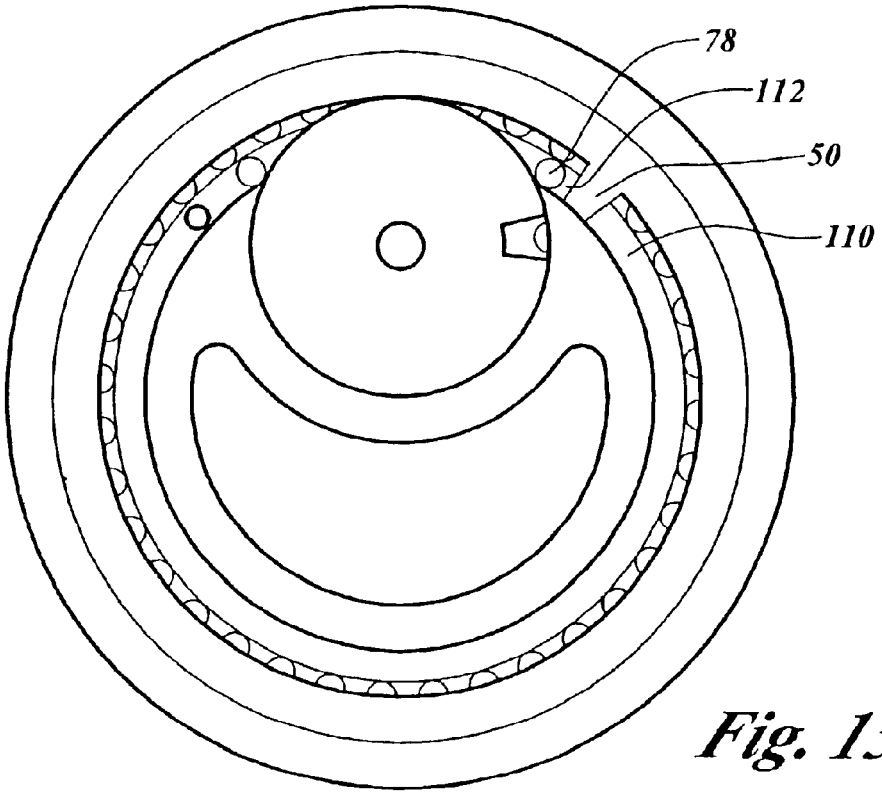
FIG. 13 is a frontal view of a state in the rotary cycle.

FIG. 13 discloses an advanced stage in the expansion cycle. At this point, the expansion cycle is nearly complete and nearly all of the available work is harvested from the expanding gases. Depending upon the desired embodiment employed, expansion ratios and fuel employed, the pressure in the increasing chamber 110 is approximately at or above ambient pressure. For embodiments designed to have expansion gases at approximately ambient pressure, substantially all available expansive work is recovered by this new thermal cycle.

In certain preferred embodiments it is desirable to employ an expansion cycle wherein the combustion products are above ambient pressure when the exhaust cycle begins. In this manner, exhaust gases are available to do work separate from driving the rotational movement of the sealing cylinder projection 68. For example, pressurized exhaust gases may be directed into a turbo charger or other air pump (not shown) that will in turn pressurize the combustion products prior to their entrance into the space 110. Likewise, the exhaust gases may drive a turbine (not shown) to generate electrical power or be used in combination with other structures (not shown) as a heating source.

Naturally, any fluids ahead of the leading edge of the projection 50 will be driven out of the space 112 by the rotating expansion ring 44. Thus, expansion products at ambient pressure are slightly pressurized just prior to exhaust. However, manipulation of the exhaust port size and geometry is anticipated to achieve desired exhaust pressures. For example, where it is desired to exhaust gases at slightly above ambient pressures, a larger, less restrictive exhaust port 78, or a plurality of ports 78 (not shown), may be used. Conversely, the port size may be relatively smaller when a more pressurized exhaust fluid is desired.

Figure 14:
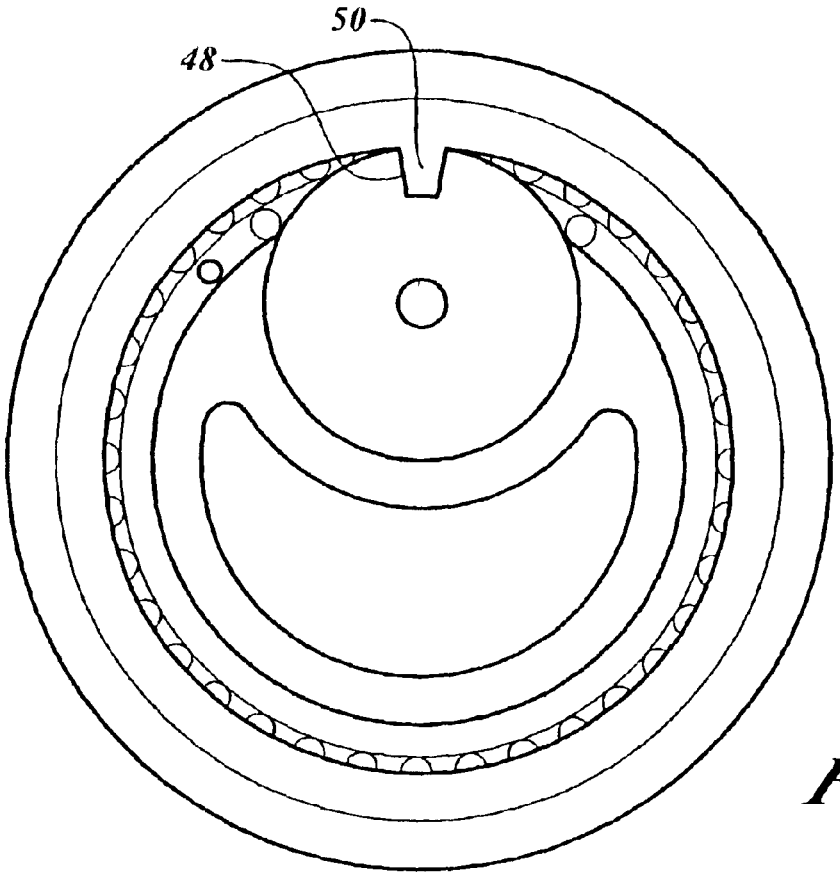
FIG. 14 is a frontal view of a state in the rotary cycle.

FIG. 14 shows the completed thermal cycle of the internal combustion embodiment of this invention. Here, the expansion ring projection 52 is mechanically mated with the inner sealing cylinder recess 48. From this point, the cycle is ready to begin again.

This new thermal cycle is free from the inertial mass changes that haunt the efficiency of the standard Otto cycle engine. Further, there is no significant preheating of the combustive products, thereby allowing the cycle to harvest the maximum expansive work from the combustion process. Likewise, there is no, or extremely minimal, loss associated with compression of the combustion products.

Analysis of Pulsed Rotary Combustion Engine

An independent analysis of the new thermal cycle was performed, demonstrating its improved efficiency.

Overview: Thermal-cycle analyses have been performed on the rotary pulsed combustion engine. Analysis was performed on embodiments with pre-compression of the combustible charge and without. In particular, a concept was analyzed whereby the volume compression ratio preceding combustion was exceeded by the volume expansion ratio following combustion. Comparisons were made with the classical Otto cycle for reciprocating (or Wankel) internal spark ignition combustion engines. The internal combustion (IC) engines are constrained by the design to have the compression volume ratio identically equal to the expansion ratio. The inherent advantage of the pulsed rotary combustion engine is that the expansion ratio can exceed the compression ratio, allowing additional conversion of the thermal energy to useful work.

Analysis: A classical thermal cycle analysis examines the path in a pressure (p) versus volume (V) plot for a charge of combustible mixture. The area inside the path line on the plot is the amount of work obtained from the original charge of combustible mixture. That is, the work $W=\int pdV$. The ratio of that work to the amount of chemical energy associated with the charge yields the thermal efficiency (after multiplying by 100%).

Figure 15:
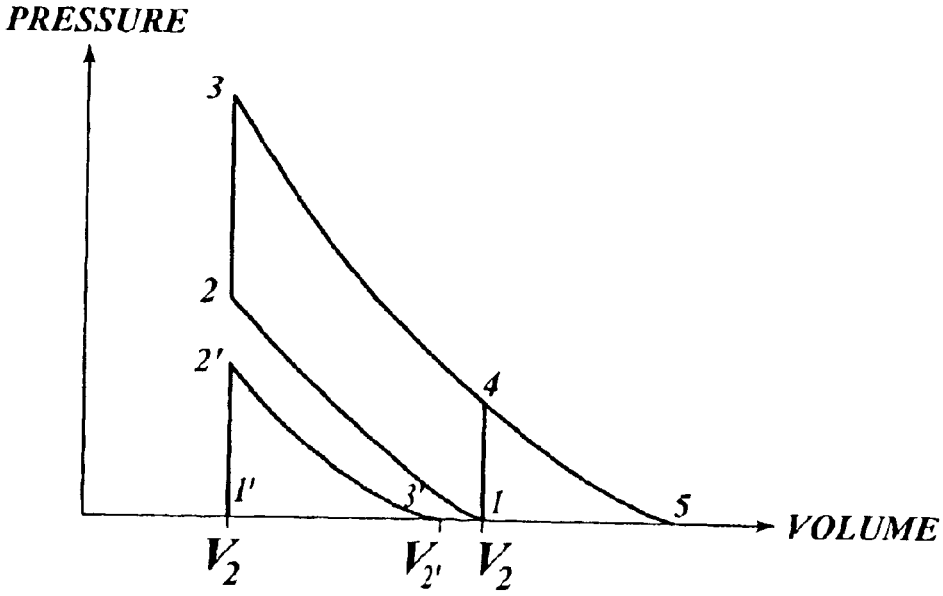
FIG. 15 is a graphical view of the thermal cycles.

The cycle involves intake shown as Point 1 in FIG. 15, compression (Path 1-2), combustion (Path 2-3), expansion (Path 3-4 or 3-5 during which work is extracted), and exhaust (Path 4-1 or Point 5). Work is performed on the charge during compression but it is less than the work extracted so that the net work is indeed positive. During the compression and expansion strokes, no heat is added or subtracted so that an adiabatic process is followed. Thereby the quantity $$pV^{\gamma} \tag{1}$$

remains unchanged during each process; $\gamma$ has a value between 1.36 and 1.40. The charge is predominantly air by weight or volume; air at room temperature has the $\gamma$ value of 1.40. It will decrease slightly with increasing temperature so that we can expect it to vary between 1.40 and 1.36 during compression. We take an average value in our calculations. The combustion product gases will have a still lower value of $\gamma$ for two reasons: higher temperature and the presence of triatomic molecules such as carbon dioxide and water vapor. For the product gases, an average value of $\gamma$=1.3 or so can be expected.

In the model cycle, the intake process involves the entrance of gases at normal atmospheric pressure $p_1$ and volume $V_1$. Compression (Path 1-2) involves increasing pressure and temperature and decreasing volume according to the adiabatic law. Then combustion (Path 2-3) occurs at constant volume with an increasing pressure and temperature. Expansion (Path 3-4 or 3-5) involves increasing volume with decreasing pressure and temperature according to the adiabatic law. Finally exhaust occurs with the gases still at an elevated temperature (Point 4 or 5). The pressure at the beginning of the exhaust is higher than the atmospheric pressure if the exhausted volume equals the intake volume. Since the pressure at exhaust equals atmospheric pressure, the exhaust volume must be much larger than the intake volume.

In comparing the various engine cycles, we will use the same fuel with the same value for chemical energy Q per mass m of the combustible mixture at stoichiometric proportions for fuel and air. The realistic value of 6.50 is taken for the quantity $Q/(mc_pT_1)$ where $c_p$ and $T_1$ are the specific heat and the intake temperature. This means that the chemical energy (Q) of the intake mixture is 6.5 times greater than its initial thermal energy ($mc_pT_1$). When the combustion occurs, the chemical energy is converted to thermal energy so that $$Q=mc_p(T_3-T_2)=mc_p(T_{2'}-T_1) \tag{2}$$

note that $T_{1'}=T_1$, which is the normal temperature of air in the atmosphere.

We consider a perfect gas so that we may employ the law $$pV=mRT \tag{3}$$

to relate pressure, volume, and temperature. M is the mass of the charge and R is the specific gas constant. With the Equations (2) and (3), we can determine the fractional pressure increase during the constant volume process.

$$\frac{p_3-p_2}{p_2}=\frac{Q}{mc_pT_2} \text{ or} \tag{4a}$$

$$\frac{p_{2'}-p_1}{p_1}=\frac{Q}{mc_pT_1}=6.5 \tag{4b}$$

Equations 3), 4a) and 4b) can be combined to give $$\frac{p_3-p_2}{p_{2'}-p_1}=\frac{V_1}{V_2}=CR \tag{5}$$

where the volume ratio CR is known as the compression ratio. Typically, CR values for automotive engines are in the 9 to 11 range while power tools have typical ratios of 7 to 8.

We can use Equation (1) for the compression process to show that $$p_1V_1^{\gamma}=p_2V_2^{\gamma} \tag{6a}$$

or $$\frac{p_2}{p_1}=CR^{\gamma} \tag{6b}$$

Note that Equation (4b) and (6b) show that a value of CR 4.22 or greater will cause the pressure $p_2$ to be larger than the value $p_2$, as indicated in FIG. 15. p and V in Equation (6a) can take any value along the path 1-2 in FIG. 15.

During the expansion process, Equation (1) also applies and yields $$p_3V_3^{\gamma e}=p_4V_4^{\gamma e}=p_5V_5^{\gamma e}=pV^{\gamma e} \tag{7}$$

where p and V can take any value along the path 3-4-5 in FIG. 15. $\gamma e$ is the ratio of specific heats for the exhaust gases which, as noted earlier, can take different values than the $\gamma$ for the intake gases.

The net work W performed for each charge of the thermal cycle is the work extracted during the expansion process minus the work performed on the charge during the compression. For the Otto cycle, we have $$W_{IC}=\int_{V_3}^{V_4}pdV-\int_{V_1}^{V_2}pdV \tag{8}$$

That is, the net work equals the area within the closed path 1-2-3-4-1 of FIG. 15. Equation (7) can be used to relate p to $p_3$, $V_1$, and V. Then the calculus of integration can be used.

We obtain the result for the classical internal combustion engine Otto cycle that $$\frac{W_{IC}}{p_1V_1}=\frac{1}{\gamma e-1}\left[1+\frac{Q}{mc_pT_1(CR)^{\gamma-1}}\right][(CR)^{\gamma-1}-(CR)^{\gamma-\gamma e}]-\frac{1}{\gamma-1}[(CR)^{\gamma-1}-1] \tag{9}$$

For the proposed rotary engine, the net work will be given by $$W_{RE} = \int_{V_3}^{V_5} p dV - \int_{V_1}^{V_2} p dV - p_1(V_5 - V_1) \quad 10)$$

that is, the net work equals the area in FIG. 15 enclosed by the path 1-2-3-5-1. Now, again using Equation 7) and 8), the integration can be performed yielding $$\frac{W_{RE}}{p_1 V_1} = \frac{1}{\lambda e - 1}\left(1 + \frac{Q}{mc_p T_1 (CR)^{\gamma-1}}\right)(CR)^{\lambda e - 1} - \frac{1}{(\gamma - 1)}[(CR)^{\gamma-1} - 1] + 1 - \left(1 + \frac{Q}{mc_p T_1 (CR)^{\gamma-1}}\right)^{(1-\gamma e)/\gamma e} CR^{[\gamma/\gamma e - 1]} \quad 11)$$

Clearly, the value of $W_{RE}$ will exceed the amount of $W_{IC}$ by the area enclosed by the path 4-5-1-4 in FIG. 15.

For the classical Otto cycle, the volume at the end of the expansion equals the intake volume; that is $V_4=V_1$. For the rotary-engine cycle, it can be shown that $$\frac{V_5}{V_1} = \left(1 + \frac{Q}{mc_p T_1 CR^{\gamma-1}}\right)^{\frac{1}{\gamma e}} CR^{\gamma/\gamma e - 1} \quad 12)$$

Therefore, the volume at the end of the expansion can be much greater than the exhaust volume.

It can be shown that, without pre-compression, the work obtained by the rotary engine is the area enclosed by the path 1'-2'-3'-1' in FIG. 15. In particular, we obtain $$\frac{W_{NC}}{p_1 V_2} = \frac{1}{\gamma e - 1}\left[1 + \frac{Q}{mc_p T_1}\right]\left[1 - \left(1 + \frac{Q}{mc_p T_1}\right)^{(1-\gamma e)/\gamma e}\right] - \left[\left(1 + \frac{Q}{mc_p T_1}\right)^{1/\gamma e} - 1\right] \quad 13)$$

In equations (9), (11), and (13), the net work is presented on the left side of the equation in a form where it is divided (or normalized) by the product of the intake pressure and the intake volume for the particular engine. The work of the engine would increase in proportion to the volume of each intake charge. So naturally, a larger engine would do more work. The power of the engine would be predicted by multiplying W by the number of firings per revolution of the engine (1 for the rotary engine and ½ for the reciprocating four-stroke engine) and then multiplying again by the engine revolutions per unit time. If the work W is given in foot-pound units and the engine speed is given in rpm, the theoretical horsepower rating can be obtained by dividing the product by 33,000. That is $$HP_{RE} = \frac{W \cdot rpm}{33000} \quad 14a)$$

and $$HP_{IC} = \frac{W \cdot rpm/2}{33000} \quad 14b)$$

Note that these are ideal evaluations that do not account for heat losses and mechanical losses. They are useful formulas, though, for making the first evaluations to compare the different engines.

The right sides of Equations (9), (11), and (13) can be calculated after specifying only the four values that we have already discussed: $Q/mc_pT_1$, CR, $\gamma$, and $\gamma e$.

| Case | $\frac{Q}{mc_pT_1}$ | $\gamma$ | $\gamma e$ | $CR = \frac{V_1}{V_2}$ | $\frac{W_{IC}}{p_1V_2}$ | $\frac{W_{NC}}{p_1V_2}$ | $\frac{W_{RE}}{p_1V_1}$ | $\frac{V_5}{V_1}$ |
|---|---|---|---|---|---|---|---|---|
| 1 | 6.5 | .38 | 1.28 | 9 | 11.01 | 5.718 | 13.546 | 3.447 |
| 2 | 6.5 | .38 | 1.28 | 7 | 10.156 | 5.718 | 12.923 | 3.507 |
| 3 | 6.5 | .38 | 1.28 | 11 | 11.77 | 5.718 | 14.138 | 3.290 |
| 4 | 6.0 | 1.38 | 1.28 | 9 | 10.191 | 5.091 | 12.448 | 3.231 |
| 5 | 6.5 | 1.40 | 1.28 | 9 | 10.78 | 5.718 | 13.135 | 3.358 |
| 6 | 6.5 | 1.38 | 1.30 | 9 | 10.722 | 5.577 | 12.986 | 3.269 |
| 7 | 6.5 | 1.40 | 1.30 | 9 | 10.79 | 5.577 | 13.12 | 3.939 |

Results: Calculations were performed for the seven cases shown in the table. Comparisons were made for three engine cycles: Otto cycle for the reciprocating engine, rotary engine cycle with the same compression ratio as the Otto cycle, and a rotary engine cycle without pre-compression but otherwise with the same parameters of the other two cycles. The work outputs for each of the cycles and the expansion-volume-to-intake-volume ratio for the rotary-engine cycle are shown in the table. Sensitivities of the results to variations in the four input parameters can be seen from the table.

Sensitivity to the compression ratio is seen by comparing Cases 1, 2, and 3. While work output increases with the compression ratio, the advantage of the rotary-engine cycle (with pre-compression) decreases as the compression ratio increases. Still, the rotary-engine cycle has a distinct advantage. The work output advantage of more than 20% comes with the disadvantage of a larger volume.

The value of $Q/mc_pT_1$=6.5 is typical for stoichiometric mixtures of the combustible charge. An off-stoichiometric mixture is simulated in Case 4. A decrease in work output is seen, but the relative advantage of the rotary engine is about the same when Cases 1 and 4 are compared.

The sensitivities to the values for the specific heats can be seen by comparing results for Cases 1, 5, 6, and 7. Increases in the values of $\gamma$ and $\gamma e$ will decrease the work output for both cycles, but the relative advantage of the rotary engine cycle is maintained.

As a reference for the conversion of work output to power, Equation 14 can show that a value of $W/p_1V_1$=13 for a 3000 rpm engine with one liter (about 61 cubic inches) of combustible intake charge at atmospheric pressure yields 88.3 horsepower. This, of course, is a theoretical value that does not account for heat losses and mechanical friction.

A further advantage to the rotary machine 40 and thermal cycle is the ability of the machine 40 to operate in a variety of configurations. The machine is employable as an external rotary combustion engine, fluid compressor, vacuum pump, drive turbine, and drive turbine for expandable gases or pressurized fluid. A more detailed discussion of various configurations is provided below.

External Combustion Engine:

FIG. 3 depicts one possible external combustion engine configuration. The only significant distinction between the internal and external combustion engine configurations is the location of combustion chamber 94. In this mode the combustion takes place outside of the housing 42 in an external combustion chamber 94, wherein the expanding gases produced from combustion are passed through the intake port 74 into the increasing space 110. Further, as combustion takes place outside of the housing, the ignition port 76 is either plugged or does not exist. The various rotary states illustrated in FIGS. 11–14 are otherwise the same as in the above internal combustion configuration. Further, fuel and air is mixable externally in all examples by traditional means such as carburetors or port-type fuel injectors.

External Combustion Engine With a Shaped Charge or Detonation Cycle Chamber:

FIG. 4 depicts one possible external combustion engine with a shaped charge or detonation cycle chamber configuration. This configuration is similar to the standard external combustion assembly above. However, here a shaped charge or other detonation cycle chamber 98 generates a compression wave to drive the rotary machine 40. Due to the extremely high pressure resulting from compression wave propagation, the rotary machine 40 is driven at much higher pressures than possible in a typical Otto cycle engine. As with the external combustion configuration, FIGS. 11–14 are illustrative of a complete thermal cycle of this invention.

In the External Combustion examples discussed above, more than one combustion chamber may be used. This will be useful to cancel detonation or shaped charge shock waves by placing two chambers opposite one another and firing them simultaneously.

Further, in all combustion engines disclosed above, the engine may be linked to additional engines to create multi-cylinder engines. The engine would be able to shut down the cylinders not required in low load conditions and increase the number of cylinders firing as the load condition increase—a fuel saving option not available on other engines. The engines not firing become flywheels when not firing.

A Gas or Air Compressor:

In this example, the driving cylinder becomes the inner sealing cylinder 44, which is rotated by a force applied externally to the sealing cylinder projection 68, and an exhaust valve (not shown) controls exhaust port 78. Additionally, the inlet port is continuously open. As illustrated in FIGS. 11–14, the sealing cylinder 62 and the expansion ring are driven in a counterclockwise direction. The rotation and closed exhaust valve compress the fluid products in the decreasing space 112 while drawing in a new charge in the increasing space 110. At a time approximated by FIG. 13, the exhaust valve opens, allowing the expulsion of the compressed fluids from the exhaust port 78. In starting the next cycle, a new charge of gas is brought in through the inlet port 74. A greater compressed gas volume is achieved by connecting more than one compressor in series, wherein the exhaust of one becomes the intake of another. In this manner, extremely high compression values are attainable.

Vacuum Pump:

FIGS. 11 through 14 show a vacuum pump cycle. The vacuum pump cycle is similar to the gas or air compressor cycle described above, except that the inlet valve 84 is located on the inlet port as opposed to the exhaust port (as in the air compressor configuration). In this fashion, the inlet valve 84 keeps the inlet port 74 closed until such time as the expansion ring projection 68 moves past the inlet port 74 in a counterclockwise direction, at which time the inlet valve 84 opens the inlet port 74 and the movement of the expansion ring creates a vacuum or negative pressure in the increasing space 110, thereby drawing in fluid products through the inlet port 54. As with the air compressor configuration above, a greater vacuum is attainable by linking a plurality of cylinders together.

Fluid or Water Pump (Pressure Type):

This configuration functions in the same manner as the air compressor above. However, the fluids in this configuration are liquid and are therefore generally incompressible. Consequently, the fluids will exit the cylinder as a unit volume into a tank or chamber (not shown) to be pressurized by compressing gases above the fluid level.

Fluid or Water Pump (Suction Type):

In a manner similar to the vacuum pump disclosed above, this rotary machine is capable of functioning as a fluid or water pump (suction type). In this mode, the inlet valve is located to control the timing of fluid products (liquid) entering the inner space.

Drive Turbine for Expandable Gases or Air:

The rotary machine 40 is capable of being used as a drive turbine for expandable (compressed) gases or air. This aspect of the invention allows the rotary machine 40 to be used as either a pulse or an economy type drive turbine. In this mode, gases or air are admitted into the increasing chamber 110 as the expansion ring projection 68 passes over inlet port 74. Gases are admitted through inlet valve 84. The gases admitted are compressed and a certain unit volume of gas is admitted per cycle. The compressed gas entering increasing chamber 110 forces both the expansion ring 44 and the inner sealing cylinder 62 to displace in a clockwise direction such that the increasing chamber 110 increases in size as the expansion ring 44 moves. When the expansion ring completes one full cycle and passes over the exhaust port 78, the volume of gas or air is back down to atmospheric pressure. Thus, the total work applied to the piston is realized. In this configuration, rotary power is taken from the sealing cylinder protrusion 68 and applied to an outside component to do work.

Drive Turbine for Liquids (Pressurized):

This is similar to the drive turbine for expandable gases or air disclosed above. Pressurized liquid is injected through the inlet valve 84 as the expansion ring projection 68 passes the inlet port 74. The inlet valve is opened, and due to the general incompressibility of liquids, the valve remains open for the complete cycle. FIG. 4 illustrates a geared valve 84 with elongated valve port 86 controlling the inlet fluids. In this configuration, pressurized liquid forces the expansion ring 44 one complete cycle until such time as it is exhausted out of the exhaust port 78.

Combinations of the Above:

The above configurations are combinable to produce a variety of results. For example, multiple sealing cylinders can be combined, one providing a degree of compression for the intake of the other. Also, gas compressors are combinable with fluid compressors. Virtually any combination of the above configurations is considered within the scope of this invention.

Likewise, the FIGURES is this application are for illustrative purposes only and are not intended to limit in any manner the geometry or relative positioning of any of the rotary components. Any geometric configuration is considered within the scope of this invention.

The embodiments of the invention in which an exclusive property or privilege is claimed are defined as follows:

1. A rotary machine, comprising:

a housing having an outer wall and an inner wall;

a rotatable sealing cylinder in sliding and sealable contact with the inner wall;

an expansion ring mechanically connected to the sealing cylinder and having an outer surface in sliding and sealable contact with the cylinder, an inner surface having a projection in sliding contact with the inner wall, whereby an expandable chamber is defined by the projection, the inner surface, the inner wall, and the cylinder;

an intake port internally disposed with the chamber; and an exhaust port, whereby the fluids delivered through the intake port to the chamber are pressurized by external ignition and cause the expansion ring to rotate and deliver the fluids to the exhaust port.

2. A rotary machine, comprising:

a housing having an outer wall and an inner wall;

a rotatable sealing cylinder in sliding and sealable contact with the inner wall;

an expansion ring mechanically connected to the sealing cylinder and having an outer surface in sliding and sealable contact with the cylinder, an inner surface having a projection in sliding contact with the inner wall, whereby an expandable chamber is defined by the projection, the inner surface, the inner wall, and the cylinder;

an intake port internally disposed in the chamber; and an exhaust port, whereby the fluids delivered to the space are ignited external to the chamber and rotation of the sealing cylinder causes the expansion ring to rotate fluids and draw in fluids through the intake port and deliver to the exhaust port.

3. A rotary machine, comprising:

a housing defining a chamber between an outer and an inner wall, the housing having a cap at an end;

an intake port to introduce an ignitable fluid into the chamber;

an induction controller means to deliver the fluid into the chamber;

an igniter in communication with the chamber to ignite the fluid and form a combustion product;

an exhaust port adapted to allow the expulsion of the product;

an expansion ring rotatably disposed within the chamber and having a projection extending radially from the expansion ring to sealably engage the inner wall;

a sealing cylinder mechanically connected to the expansion ring and having a recess to receive the expansion ring projection, at least one sealing cylinder projection extending generally axially from the sealing cylinder through the housing to transmit rotation movement to or from the sealing cylinder, wherein the sealing cylinder and expansion ring form a substantially sealed contact area, such that the movement of the sealing ring causes movement of the expansion ring;

a space defined by a trailing edge of the expansion ring projection, the inner wall, the expansion ring, and the contact area, and wherein at an intake time, the space receives the fluid from the induction controlling means, so that the moving expansion ring causes the delivery of the product to the exhaust port.

4. The rotary machine of claim 3, wherein the fluid received in the space is ignited within the space.

5. The rotary machine of claim 3, wherein the product received within the space is expanding combustion gases received from an external combustion chamber.

6. The rotary machine of claim 3, wherein the product received within the space are compression waves generated from a shaped charge or detonation cycle combustion chamber.

7. The rotary machine of claim 3, wherein the products received within the space are compressible fluids.

8. The rotary machine of claim 3, wherein the products received within the space are vacuum products induced into the space by rotary motion of the expansion ring and the sealing cylinder.

9. The rotary machine of claim 3, wherein the products received within the space are pressurized fluids induced into the space to drive the rotary motion of the expansion ring and sealing cylinder.

* * * * *